United States Patent [19]

Haines

[11] Patent Number: 4,831,989

[45] Date of Patent: May 23, 1989

[54] CONTROL VALVE

[75] Inventor: Steven N. M. Haines, London, England

[73] Assignee: Lucas Industries Public Limited Company, Birmingham, England

[21] Appl. No.: 922,210

[22] Filed: Oct. 23, 1986

[30] Foreign Application Priority Data

Nov. 12, 1985 [GB] United Kingdom ..... 8527827

[51] Int. Cl.[4] ..... F02M 39/00

[52] U.S. Cl. ..... 123/506; 123/458; 137/522

[58] Field of Search ..... 123/506, 458, 503, 500–501; 137/513.3, 522; 251/82

[56] References Cited

U.S. PATENT DOCUMENTS

| | | | |
|---|---|---|---|
| 3,719,401 | 3/1973 | Peruglia | 137/522 |
| 4,563,992 | 1/1986 | Kobayashi | 123/458 |
| 4,586,480 | 5/1986 | Kodayashi | 123/506 |
| 4,598,685 | 7/1986 | Logie | 123/458 |
| 4,665,875 | 5/1987 | Lakin | 123/506 |

*Primary Examiner*—Carl Stuart Miller

*Attorney, Agent, or Firm*—Balogh, Osann, Kramer, Dvorak, Genova & Traub

[57] ABSTRACT

A control valve for use in a fuel injection system of an engine comprises a valve member of plate like form and movable in an inlet chamber between a first seating and a second seating on opposite sides of the valve member. The first sealing is smaller in diameter than the second seating and surrounds a spill flow passage. The inlet chamber connects in use with the pump chamber of a fuel pump. When the valve member is in contact with the second seating a control chamber is formed which is connected by a restricted passage to the pump chamber. Flow of liquid from the control chamber is controlled by a valve element which is movable by an actuator and which conveniently controls flow through an opening in the valve member. In the closed position of the valve member it engages the first seating and the opening is closed by the element. In order to open the valve the opening is uncovered by the valve element and the unbalanced pressure on the opposite sides of the valve member move the valve member to the open position and into contact with the second seating. Reclosure of the valve is achieved by covering the opening.

14 Claims, 7 Drawing Sheets

CONTROL VALVE

This invention relates to an electromagnetically controlled valve for use in a fuel injection system of an internal combustion engine.

A known form of fuel injection system comprises a plunger reciprocable within a pump chamber from which extends an outlet connected in use to an engine injection nozzle or by way of a distributor member to a plurality of such nozzles. The control of fuel flow through the outlet is effected by an electromagnetically controlled valve.

Various forms of valve are known in the art. One form includes a valve member which is coupled to the armature of a solenoid and this form of valve tends to require in view of the high fuel pressures which are developed in the fuel system, that the solenoid/armature combination should be capable of developing a considerable force. Efficient designs of armature and solenoid are known but even so substantial electrical power can be required to achieve operation of the valve at a sufficiently high speed for its use in an engine fuel system. Other forms of valve comprise a main valve and pilot valve combination with the pilot valve being electrically operated and dealing either with a lower fuel pressure or a reduced fuel flow so that the valve operator can be of reduced power. With this arrangement the electrical power requirements are reduced at the expense of increased mechanical complexity, bulk and longer delays in the operation of the valve.

The object of the invention is to provide an electromagnetically controlled valve for use in a fuel injection system for an internal combustion engine in an improved form.

According to the invention a valve for the purpose specified comprises a body defining a first seating about a flow passage extending in use to a drain, said body defining an inlet chamber about said seating for connection in use to a high pressure fuel source of the system, a second seating facing but spaced from said first seating and enclosing a larger area than the first seating, a plate valve member movable between the seatings, said plate valve member when engaging said second seating defining therewith a control chamber, first passage means connecting said control chamber with said inlet chamber, second passage means connecting said control chamber with a drain and an electromagnetically operated valve element for controlling fuel flow through said second passage means, the arrangement being such that in the open position of said valve element the force developed on the face of the plate valve member lying outside said first seating, will urge the plate member into contact with said second seating, and in the closed position of the valve element the pressure in the control chamber will urge the plate valve member from the second seating towards the first seating.

Figure 1:
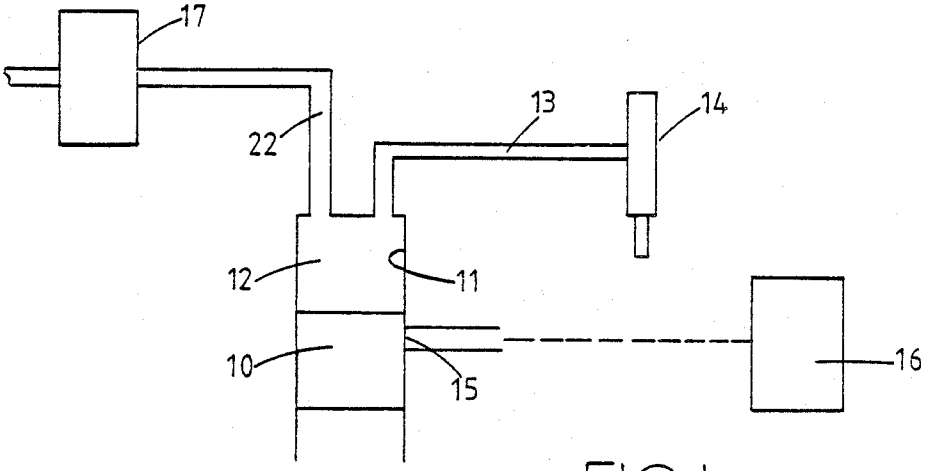

Examples of valve in accordance with the invention will now be described with reference to the accompanying drawings in which:

FIG. 1 is a diagrammatic representation of a fuel system with the valve of the invention shown in outline only, and FIGS. 2–15 show various examples of valve.

Referring to FIG. 1 of the drawings a typical fuel system comprises a pumping plunger 10 reciprocable within a bore 11, the bore 11 and the plunger 10 defining a pumping chamber 12 from which extends an outlet 13 connected in use, to a fuel injection nozzle 14. The plunger in a typical fuel system is moved inwardly to reduce the volume of the pumping chamber 12, by means of a cam driven by the associated engine and can be driven outwardly by the action of a spring or by cam action or by fuel pressure. Moreover, although the outlet 13 is shown connected to a single injection nozzle, it can by way of a suitable distributor member, be connected to a plurality of injection nozzles.

Formed in the wall of the bore 11 is a fuel supply port 15 which is connected to a source 16 of fuel at a low pressure and the arrangement is such that when the plunger 10 uncovers the port 15 during the outward movement of the plunger, fuel can flow into the pumping chamber. By this method the pumping chamber is completely filled with fuel.

Also communicating with the pumping chamber 12 is a control valve 17 which can be opened to allow fuel to escape from the pumping chamber 12 during the inward movement of the plunger, rather than flow through the outlet 13 to the distributor member or a nozzle. The valve 17 is closed during the inward movement of the plunger so as to cause delivery of fuel to the injection nozzle and later during the inward movement of the plunger it can be opened to terminate the delivery of fuel.

Figure 2:
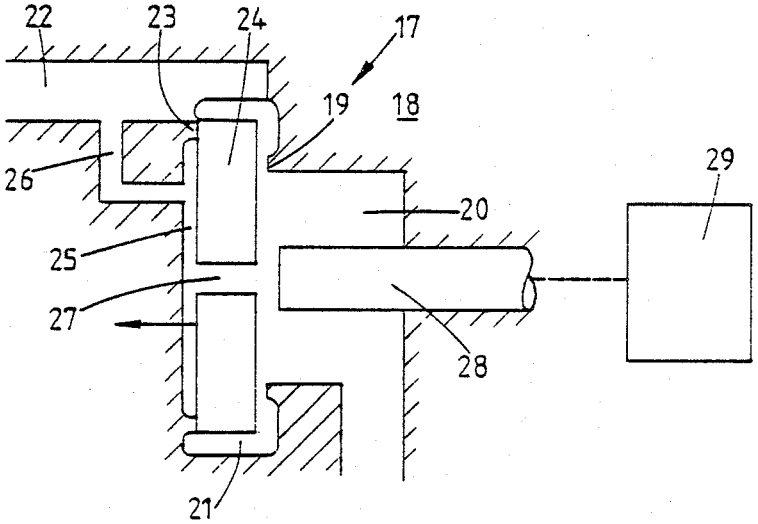
Figure 3:
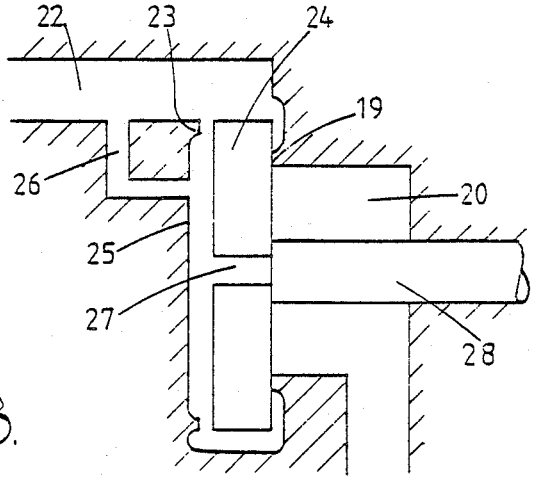

FIGS. 2 and 3 of the drawings show a first example of the valve 17, FIG. 2 illustrating the valve in the open position wherein fuel can flow through the valve 17 from the pumping chamber to a drain and FIG. 3 showing the valve in the closed position.

The valve comprises a body 18 in the interior of which is defined a first annular seating 19 about a flow passage 20 which extends to a drain. Exterior of the seating 19 there is defined an inlet chamber 21 which is connected by way of a passage 22, to the pumping chamber 12. A second annular seating 23 is provided which faces the seating 19 in spaced relationship. The diamerer of the seating 23 is larger than that of the seating 19 and located between the seatings is a plate valve member 24 which has a diameter slightly larger than that of the seating 23. The thickness of the member is less than the distance between the seating. In the open position of the valve as shown in FIG. 2, the plate valve member 24 defines with the seating 23 a so-called control chamber 25. The control chamber 25 communicates by way of a first passage means in the form of a restricted passage 26, with the passage 22 and it communicates by way of a second passage means with the flow passage 20. Conveniently the second passage means is constituted by an opening 27 formed in the plate valve member 24. For controlling the flow of fuel through the opening 27 there is provided a valve which is constituted by a valve element 28 extending within the flow passage 20, and movable by an electromagnetic actuator 29.

As mentioned above, FIG. 2 shows the valve in the open position and assuming that fuel is being displaced from the pumping chamber, the fuel will flow between the seating 19 and the adjacent surface of the valve member and then through the flow passage 20. A small flow of fuel will occur through the passage 26 in the control chamber and through the opening 27. However, the pressure of fuel in the control chamber 25 will be substantially equal to that in the flow passage 20. There will however be a pressure difference between the inlet chamber 21 and the flow passage 20 due to the slightly restricted nature of the flow path defined between the seating 19 and the adjacent face of the valve member and the pressure in the inlet chamber acting upon the face of the valve member which lies outside the seating 19, will be sufficient to hold the valve member against the seating 23.

In order to close the valve the valve element 28 is moved by the actuator 29 to close the second passage means by closing the opening 27. This is achieved by energising the actuator. When the opening 27 is closed the pressure in the control chamber increases towards that which obtains in the passage 22 and it is arranged that the area of the valve member subject to this pressure is sufficient to develop a force on the valve member which tends to move the valve member away from the seating 23. When separated from the seating the surface of the valve member on the side facing the seating 23 is exposed to the full pressure in the passage 22 and the valve member moves towards the closed position as seen in FIG. 3. During movement of the valve member the valve element 28 must also be moved against the force developed by the actuator. The movement required may be very small but nevertheless, the actuator must be designed or controlled to allow such movement and this can be arranged by the provision of a lost motion spring whereby the magnetic components of the actuator can move to a minimum air gap position while at the same time allowing the valve element to be moved in the opposite direction by the forces applied to the plate valve member.

The movement of the valve member between the seatings is extremely small and it is possible that the initial movement of the valve member 24 can be initiated by only partial closure of the opening 27 sufficient to restrict the flow of fuel through the opening, by the valve element 28. In this case it may be possible to arrange that the travel of the valve element is no more than is required to close the opening when the valve member 24 is in contact with the seating 19. In this case the valve element can be directly coupled to the moving component of the actuator.

If once the valve has been closed, it is required to reopen the valve, the actuator 29 is de-energised to allow the valve element 28 to withdraw and thereby allow fuel flow through the opening 27. The pressure drops which take place due to flow between the seating 23 and the adjacent face of the valve member 24 and through the passage 26 are sufficient to lower the pressure applied to said face a sufficient amount so as to allow the valve member to move under the action of the pressure acting on the area of the valve member lying outside the seating 19, to the open position shown in FIG. 2. It will be appreciated however that once the valve element 28 has uncovered the opening 27 the pressure in the passage 22 will start to fall so that the pressure in the pumping chamber of the pump will also fall thereby allowing the valve member in the fuel injection nozzle to close. A disadvantage with the above arrangement is that in the closed position of the valve part of the end of the valve element 28 equivalent to the area of the opening 27, is subjected to the high pressure of fuel which is developed in the pumping chamber of the pump and therefore the force which must be developed by the actuator 29 must be sufficiently high to maintain the opening 27 closed. An advantage of this arrangement however is that no spring is required to return the valve element 28 to the position shown in FIG. 2.

Figure 4:
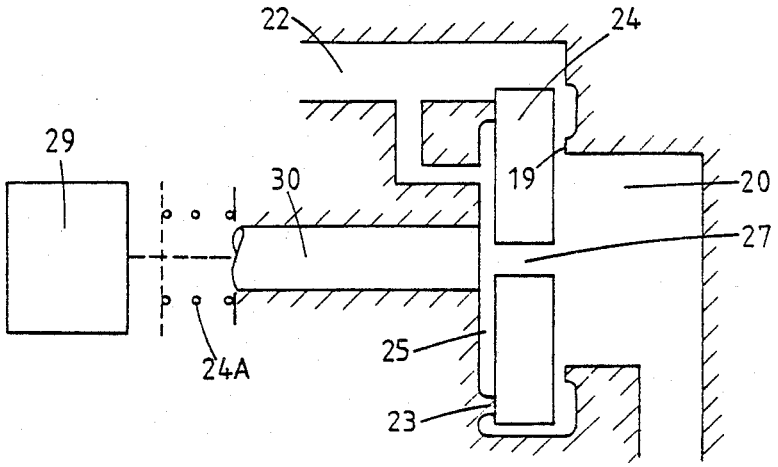
Figure 5:
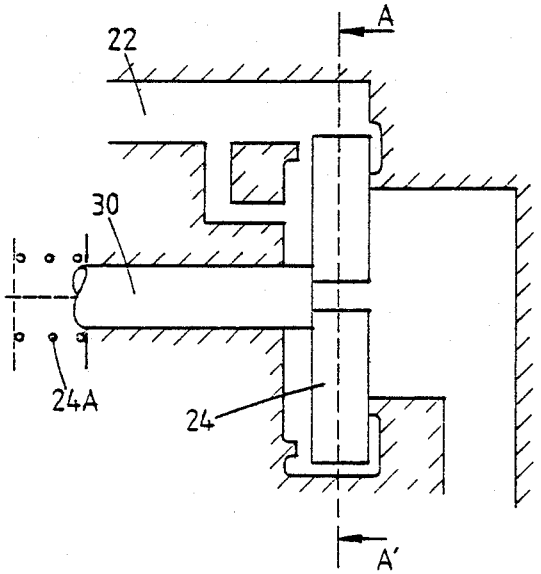
Figure 5A:
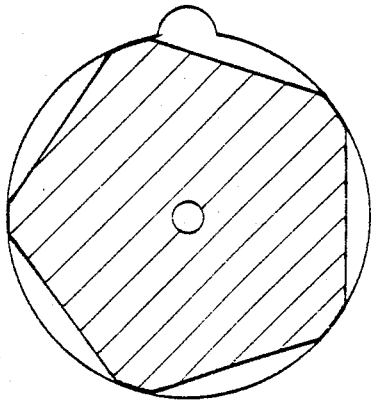

An alternative arrangement is seen in FIGS. 4 and 5 and in this arrangement parts having the same function are assigned the same reference numerals as those of FIGS. 2 and 3. It will be immediately apparent that the valve element 30 is positioned on the opposite side of the plate valve member 24. FIG. 4 shows the valve in the open position and when it is desired to close the valve the actuator is energised and the valve element 30 moves forwardly to prevent flow of fuel through the opening 27 thereby to cause an increase in the pressure in the control chamber 25. This increases in pressure in the control 19 with the valve element 30 following the movement of chamber causes, as with the example of FIGS. 2 and 3, movement of the plate valve member towards the seating 19 with the valve element 30 following the movement of the plate valve member. In the closed position of the valve as shown in FIG. 5 the force which has to be exerted by the actuator to maintain the opening 27 closed, is lower than in the example of FIGS. 2 and 3 since the part of the valve element equal in area to the opening 27 is subjected to the low pressure in the passage 20. However, the working clearance between the valve element 30 and the wall of the bore in which it is mounted, must be carefully controlled in order to minimize leakage of fuel due to the fact that the pressure in the control chamber 25 when the valve is in the closed position, is the same as the pressure in the pumping chamber. When it is required to reopen the valve the actuator is de-energised and the initial movement of the valve element 30 takes place under the action of a spring 24A. This means that the rate of fall of pressure in the passage 22 and therefore in the pumping chamber will probably be less than with the example shown in FIGS. 2 and 3 since the valve element and the valve member move in the same direction. FIG. 5A is a section on the line A—A of FIG. 5 and shows that the valve member is guided at its peripheral surface.

Figure 6:
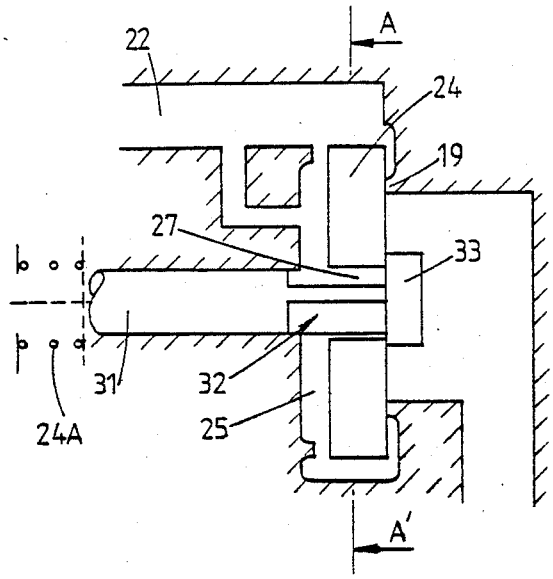
Figure 6A:
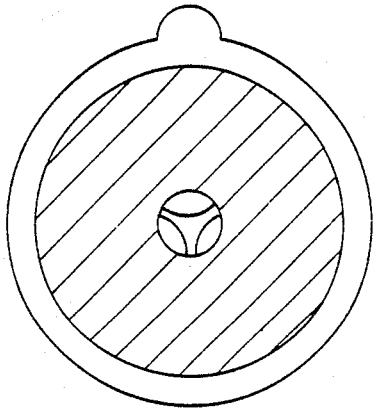

FIG. 6 shows a modification of the arrangement which is shown in FIGS. 2 and 3, the valve being shown in the closed position and the section which is shown in FIG. 6 being taken along the line A—A of FIG. 6. Again the same reference numerals are used where appropriate. In the example of FIG. 6 the valve element 31 extends into the control chamber 25 but it has a fluted portion 32 which supports a valve head 33 engageable to close the opening 27, with the side of the plate valve member 24 which engages the seating 19. In the closed position of the valve as shown in FIG. 6, it will be appreciated that the forces acting on the valve element due to fuel pressure in the passage 22, are substantially balanced and the same comment applies when the valve is in the open position. The force required to be developed by the actuator is therefore very much reduced although, as with the example of FIG. 5, it is necessary to have a spring 24A to bias the valve element so that when the actuator is de-energised, the head 33 can move to allow fuel flow through the opening 27. Again this arrangement does suffer from the disadvantage that fuel leakage can occur along the working clearance defined between the valve element and the wall of the bore in which it is located. As shown the valve member is supported by the fluted portion 32 of the valve element but it can be supported at its peripheral surface as shown in FIG. 5A.

Figure 7:
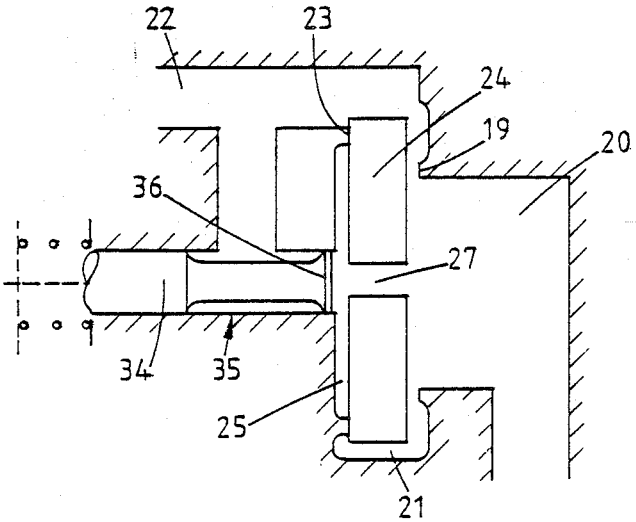
Figure 8:
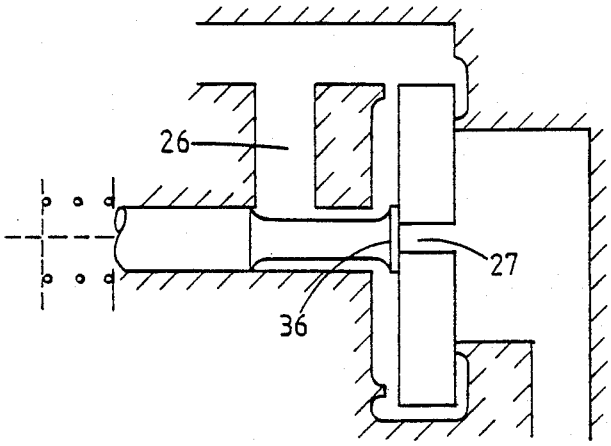

FIGS. 7 and 8 show a further example of the valve and again the same reference numerals are used wherever possible. In this case the valve element 34 besides controlling the opening 27 also controls the admission of fuel from the passage 22 into the control chamber 25. The valve element for this purpose is provided with a reduced portion 35 which defines a valve head 36 which in the energised condition of the actuator closes the opening 27 to cause, in the manner described, closure of the valve. When the actuator is de-energised the valve element is moved by a spring and the head 36 enters into the bore which accommodates the valve element 34, this bore being part of the so-called first passage means. In the de-energised condition therefore substantially no fuel flow occurs through the first passage means into the control chamber. However, as soon as the actuator is energised the valve head 36 moves out of the bore to permit fuel flow into the control chamber 25 and also closes the opening 27. The advantage of this arrangement is that for the same size of opening 27, the rate of opening of the valve is increased. Alternatively, for an equivalent performance to the example shown in FIGS. 4 and 5, the size of the opening 27 can be reduced. A possible disadvantage with this construction is that during closure of the spill valve member the forces due to fuel pressure acting on the element may not be balanced and may produce a force tending to oppose the movement of the valve element by the actuator.

Figure 9:
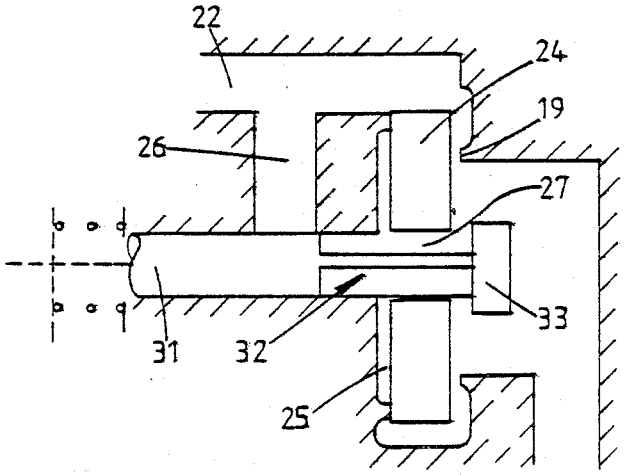

FIG. 9 shows the principle of closure of the first passage as illustrated in FIGS. 7 and 8 applied to the example of FIG. 6. As shown in FIG. 9, the valve element 31 mounting the head 33, as in the example of FIG. 6, controls the flow of fuel to the control chamber 25 through the passage 26. As shown in FIG. 9 the passage 26 is closed but when it is required to move the valve to the open position, the actuator is energised to cause the head 33 to close the opening 27 and at the same time, fuel from the passage 26 will be allowed to flow along the fluted portion 32 of the valve element into the control chamber.

Figure 10:
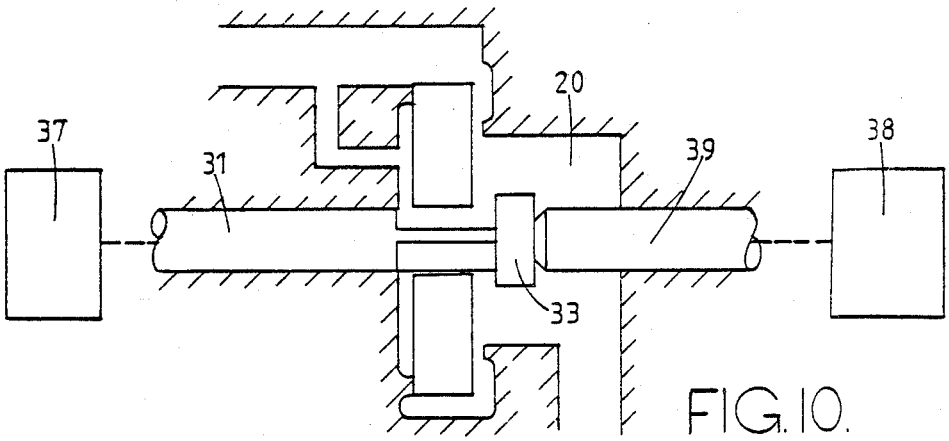

In FIG. 10 there is shown a modified form of valve in which the valve element 31 being of the same type as used in the example of FIG. 6, is driven by a pair of actuators 37, 38 acting on the element in opposition to each other. The actuator 37 is directly coupled to the valve element and the actuator 38 acts on the element through a push member 39 which extends through the flow passage 20 for engagement with the head 33. No springs are required in this example. The purpose of this arrangement is to take advantage of the more consistent operating characteristic which is obtained when an actuator is deenergised and the magnetic flux falls. It is preferable that the two actuators should have as near as possible identical characteristics. In FIG. 10 the valve is shown in the open position with the actuator 37 energised and hence the air gap or gaps in its magnetic circuit are as small as possible. If the actuator 38 is energised the force it will produce will be less than the force produced by the actuator 37 because the air gaps in its magnetic circuit will be large. If the actuator 37 is de-energised the force exerted by the actuator 38 will predominate and will increase as the valve element starts to move. As the head 33 closes the central opening in the valve member, the valve will move to the closed position. If after the valve has closed the actuator 37 is energised the valve head 33 will remain in the position in which it closes the opening because the actuator 38 will be exerting the greater force. If now the actuator 38 is de-energised the valve element will move under the influence of the force exerted by the actuator 37. Thus it is the de-energising of an actuator which causes movement of the valve element and hence operation of the valve. While this arrangement should produce more consistent valve operation, the actual time for operation of the valve may be increased because of the increased mass of the moving parts.

Figure 11:
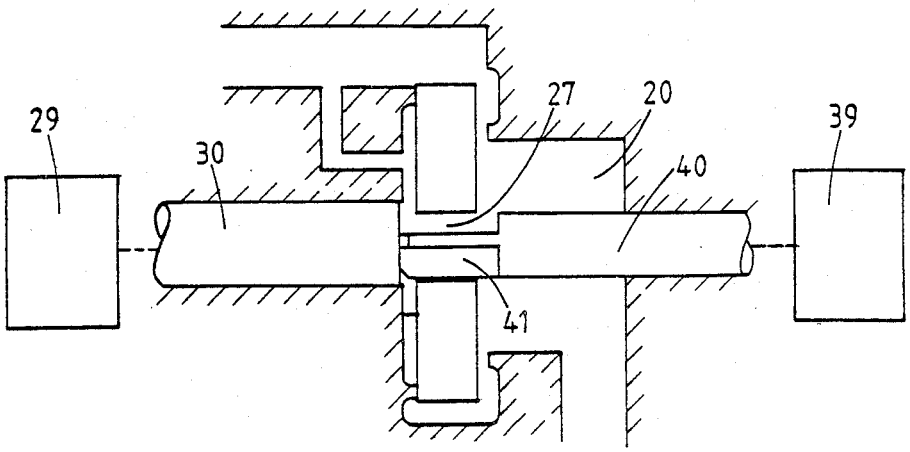

FIG. 11 shows a valve of the type shown in FIG. 4 but incorporating a further actuator 39 acting in opposition to the actuator 29. The actuator 39 acts on the valve element 30 through a push member 40 which has a fluted portion 41 extending through the opening 27. The operation of the two actuators to achieve movement of the valve element is conducted in the manner described with reference to FIG. 10, again no springs are required.

Figure 12:
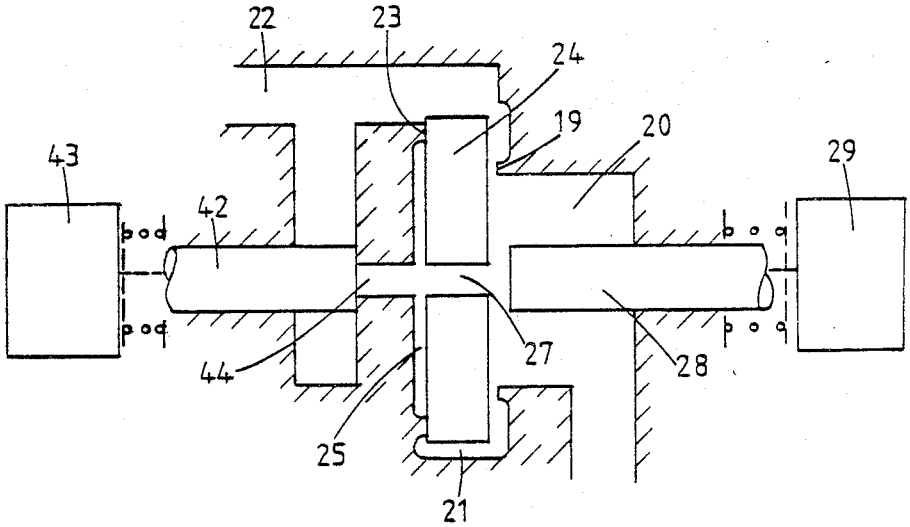

FIG. 12 shows a further form of valve in which the control of the valve is effected by two actuators but in this case the actuators are mechanically separate from each other and incorporate springs. In FIG. 12 identical reference numerals to those used in the earlier examples are used. The valve element 28 controlled by the actuator 29 is used to control the opening 27 in the valve member but a further valve element 42 controlled by an actuator 43 is used to control flow of fuel into the control chamber 25. In FIG. 12 the valve is shown in the open position with the actuator 43 energised and the valve element 42 closing an opening 44 into the control chamber 25. The actuator 29 is de-energised and the valve element 28 removed from the opening 27. In order to close the valve the actuator 29 is energised to close the opening 27 and then the actuator 43 is de-energised to open the opening 44 to allow fuel to flow into the control chamber 25. The plate valve member under the influence of the pressure in the control chamber moves into contact with the seating 19 to close the valve, the valve element 28 being urged against the action of the actuator in the process. In order to reopen the valve the actuator 43 is first energised to close the opening 44 and then the actuator 29 is de-energised to open the opening 27 whereafter the plate valve member moves into contact with the seating 23. In both the opening and closing directions, movement of the plate valve member is initiated by de-energising an actuator.

Figure 13:
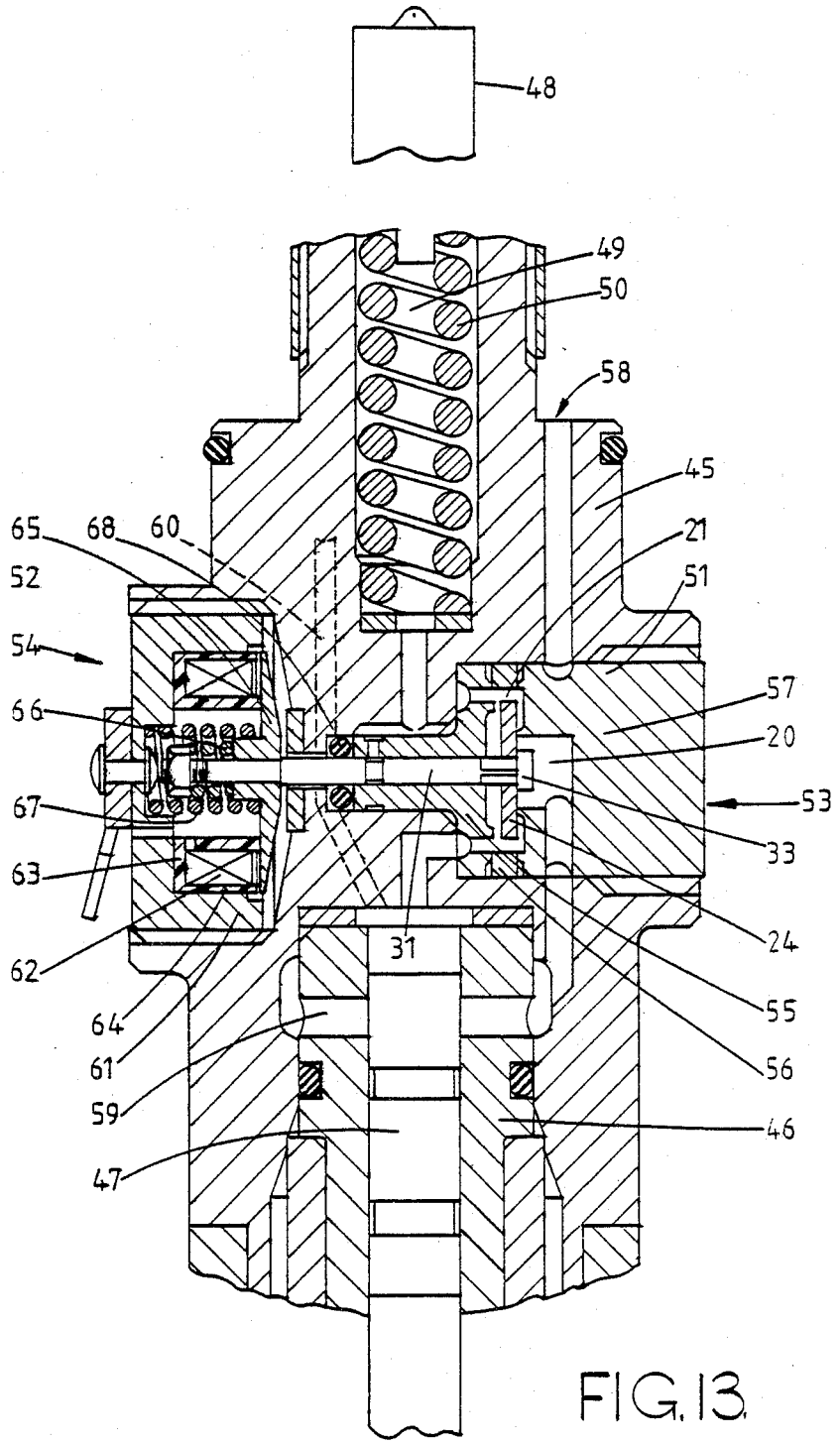

FIG. 13 illustrates in part sectional side elevation, a so-called pump/injector incorporating the example of the valve which is seen in FIG. 6. The pump/injector includes a body part 45 in which is mounted a pump barrel 46 defining a bore to accommodate the pumping plunger 47. The latter is connected to a tappet mechanism which is biased outwardly by a spring not shown, the tappet mechanism being adapted to be engaged in use by an engine driven cam. At the opposite end of the body part is mounted an injection nozzle assembly 48 of conventional construction, the body part defining an elongated recess 49 which accommodates the closing spring 50 of the injection nozzle.

The body part is provided with a pair of diametrically disposed recesses 51, 52 the recess 51 accommodating a valve assembly 53 and the recess 52 accommodating an actuator assembly 54. The valve assembly 53 comprises a flanged inner body 55, an annular spacer 56 and an outer body 57. The inner body 55 is provided with a longitudinal bore in which is mounted the valve element 31 the latter being provided, as in the example of FIG. 6, with a head 33. The valve element 31 extends out of the bore into the recess 52. The face of the flanged portion of the inner body presented to the outer body defines the seating 23 which in this case is provided with a number of grooves so that it does not provide a proper seal with the plate valve member 24. The grooves therefore form the so-called first passage means into the control chamber. The outer body 57 defines the seating 19 about the flow path 20 which is connected by a passage to a circumferential groove formed on the periphery of the outer body 57 and which communicates with a fuel inlet 58 defined in the body part 45, the fuel inlet in use being connected to a source of fuel under pressure.

The aforementioned circumferential groove also communicates with a fuel gallery defined in the body part 45 and surrounding the pump barrel. The gallery communicates by way of a pair of ports 59, with the bore accommodating the plunger 47, the ports 59 being positioned so that during inward movement of the plunger, they are covered. The bore in the pump barrel is connected with a circumferential recess formed in the surface of the flanged portion of the inner body, the flanged portion also defining a plurality of angularly spaced openings which open into the inlet chamber 21. The outer body is peripherally screw threaded so as to enable it to be secured in the recess 51, the body effecting sealing engagement with the insert 56, the latter also forming a seal with the flanged portion of the inner body. The bore which accommodates the plunger 47 communicates with the inlet of the fuel injection nozzle by way of a passage shown in dotted outline at 60.

The actuator assembly includes a cup shaped member 61 formed from non-magnetic material. The peripheral surface of the cup-shaped member is provided with a screw thread whereby it can be screwed into the recess 52. The cup-shaped member mounts a solenoid assembly which includes a winding 62 and a pair of core parts 63, 64 the core part 63 is of annular form and is of "L" section. The outer core member is of tubular form and is pressed about the winding before inserting the solenoid assembly into the housing part.

An annular disc like armature 65 is located against a step defined on the valve element 31, the latter carrying a nut between which and the armature is located a lost motion spring 66. The armature and valve element are biased by means of a coiled compression spring 67 to oppose the movement of the armature by the magnetic field generated when the winding 62 is energised. As shown, the plunger 47 is moving upwardly with the ports 59 closed and the valve closed so that fuel is being delivered to the injection nozzle 48.

When the valve is in the closed position the working clearance between the valve element and the bore in which it is located, will constitute a leakage path and whilst leakage is kept to a minimum, some leakage will occur and this is collected in a groove formed in the valve element and returned to a drain. In order to prevent fuel entering into the actuator assembly, a resilient sealing member 68 is located about the valve element 31.

Figure 14:
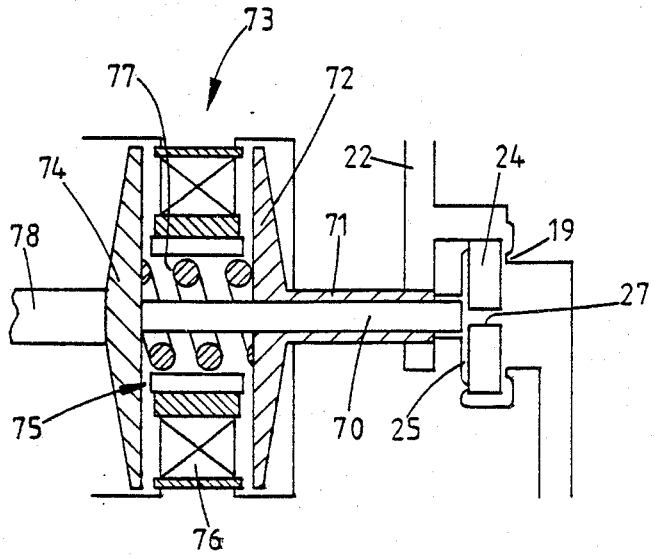
Figure 15:
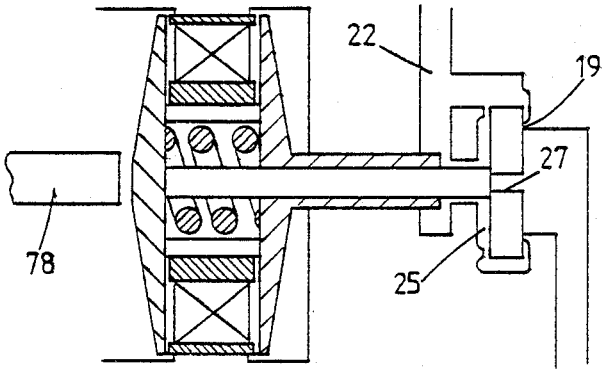

FIGS. 14 and 15 show another variation of the valve which functions in the same way as the valve shown in FIGS. 7 and 8 but it has two separate valve elements for controlling the flow through the opening 27 and the flow into the control chamber from the passage 22. The valve element 70 which controls the flow through the opening 27 comprises a rod which is slidably mounted in a sleeve 71 which forms the valve element which controls flow into the chamber 25. The sleeve is coupled to a first armature 72 of an actuator 73 and the rod is engaged by a second armature 74, the two armatures being located on opposite sides of a central core structure 75 including a winding 76. The two armatures are biased apart by means of a coiled spring 77 and a stop 78 is provided for engagement by the armature 74.

In the de-energised condition of the actuator 73 the armature 74 engages the stop and the sleeve 71 is urged to prevent fuel flow into the control chamber. Moreover, the valve element 70 is retracted so that the opening 27 provides communication between the control chamber and the flow passage 20. The valve therefore assumes the open position. In order to close the valve the winding 76 is energised and the two armatures are attracted to the core structure 75 as shown in FIG. 15. The effect is to close the opening 27 and to allow fuel flow into the control chamber causing the valve member to move into contact with the seating 19 thereby closing the valve.

I claim:

1. An electromagnetically controlled valve for use in a fuel injection system of an internal combustion engine comprising a body defining a first annular seating about a flow passage extending in use to a drain, said body defining an inlet chamber about said first seating for connection in use to a high pressure fuel source of the system, a second annular seating facing but spaced from said first seating and enclosing a larger area than the area enclosed by said first seating, a plate valve member movable between the seatings to contact said first seating when the electromagnetically controlled valve is closed and to contact said second seating when the electromagnetically controlled valve is open, said plate valve member when engaging said second seating defining therewith a control chamber which has an area that is larger than that area enclosed by said first seating, first passage means connecting said control chamber with said inlet chamber, second passage means connecting said control chamber with a drain, and an electromagnetically operated valve element for controlling fuel flow through said second passage means, said electromagnetically operated valve element being movable to close said second passage means in the closed position of the electromagnetically operated valve element and to open said second passage means in the open position of said electromagnetically operated valve element, the arrangement and relative sizes of said areas being such that in the open position of said electromagnetically operated valve element the force developed by the fuel flowing through said body on the face of the plate valve member lying outside said first seating and tending to urge the electromagnetically controlled valve open will exceed the force on the plate valve member which tends to urge the electromagnetically controlled valve closed to urge the plate valve member into contact with said second seating, and in the closed position of the electromagnetically operated valve element the force associated with pressure of fuel in the control chamber on the plate valve member which tends to urge the electromagnetically controlled valve closed will exceed the force on the plate valve member which tends to urge the electromagnetically controlled valve open to urge the plate valve member towards the first seating.

2. A valve according to claim 1 in which said second passage means is defined by an opening in the valve member.

3. A valve according to claim 2 in which said valve element engages said valve member on the side thereof presented to the first seating to prevent flow of fuel through said opening.

4. A valve according to claim 3 in which said valve element extends through said flow passage.

5. A valve according to claim 3 in which said valve element has a head for engagement with said side of the valve member, the valve element having a fluted portion which extends through said opening and the remaining portion of the valve element being located in and slidable within a bore in the body said bore extending away from the side of the valve member presented to the second seating.

6. A valve according to claim 5 in which the valve element additionally controls the flow of fuel through said first passage means whereby in the open position of the valve member flow of fuel through said first passage means is prevented, said first passage means being opened and said opening closed when the valve element is actuated to close the valve.

7. A valve according to claim 5 including first and second electromagnetic actuator means for said valve element said actuator means acting in opposite directions on said valve elements.

8. A valve according to claim 5 including resilient means acting on the valve element in the direction to bias the valve element away from said second seating.

9. A valve according to claim 3 including a further electromagnetically operated valve element operable to control fuel flow through said first passage means.

10. A valve according to claim 2 in which said valve element engages said valve member on the side thereof presented to the second seating to prevent flow of fuel through said opening, said valve element being located and slidable in a bore in the body, said bore extending away from the side of the valve member presented to the second seating.

11. A valve according to claim 10 including resilient means acting on said valve element in the direction to bias the valve element towards said first seating.

12. A valve according to claim 10 in which said valve element additionally controls the flow of fuel through said first passage means, whereby when said valve element is moved to uncover said opening the first passage means will be closed.

13. A valve according to claim 10 including first and second electromagnetic actuator means for said valve element, said actuator means acting in opposite directions on said valve element.

14. A valve according to claim 10 including a further valve element for controlling fuel flow through said first flow passage, a pair of armatures connected to the valve elements respectively, said armatures being disposed on opposite sides of an electromagnetic structure whereby when said magnet structure is energised the valve elements will move to close said opening and open the first passage means to cause closure of the valve, resilient means acting between the armatures whereby when the magnet structure is de-energised the valve elements will be moved to uncover said opening and close said first passage means to cause opening of the valve.

* * * * *